United States Patent [19]

Perneczky

[11] Patent Number: 4,841,675

[45] Date of Patent: Jun. 27, 1989

[54] APPARATUS FOR CLEANING AND POLISHING ROLL ASSEMBLIES

[76] Inventor: George C. Perneczky, 8918 Biloba, Orland Park, Ill. 60462

[21] Appl. No.: 193,596

[22] Filed: May 13, 1988

[51] Int. Cl.[4] ..... B24B 5/37

[52] U.S. Cl. ..... 51/67; 51/289 R; 51/252

[58] Field of Search ..... 51/59 R, 251–253, 51/289 R, 68, 69, 67

[56] References Cited

U.S. PATENT DOCUMENTS

| | | | |
|---|---|---|---|
| 1,212,131 | 1/1917 | Coate | 51/252 |
| 1,227,775 | 5/1917 | Friess | 51/67 |
| 1,963,781 | 6/1934 | Evans | 51/253 |
| 2,195,064 | 3/1940 | Wallace | 51/59 R |
| 2,286,596 | 6/1942 | Brayshaw | 51/252 |

*Primary Examiner*—Frederick R. Schmidt
*Assistant Examiner*—Robert A. Rose
*Attorney, Agent, or Firm*—Neuman, Williams, Anderson & Olson

[57] ABSTRACT

An apparatus is provided for cleaning and polishing the surface of cylindrical rolls. The apparatus is characterized by a shaft connected at each end thereof to end units. The end units are movable toward and away from the surface of the roll to be cleaned and polished. The end units are also adapted to reciprocate the shaft along its longitudinal axis. At least one abrasive stone attachment means, including an abrasive stone, is attached to the shaft such that the abrasive stone can be positioned in substantial contact with the surface of the roll.

13 Claims, 5 Drawing Sheets

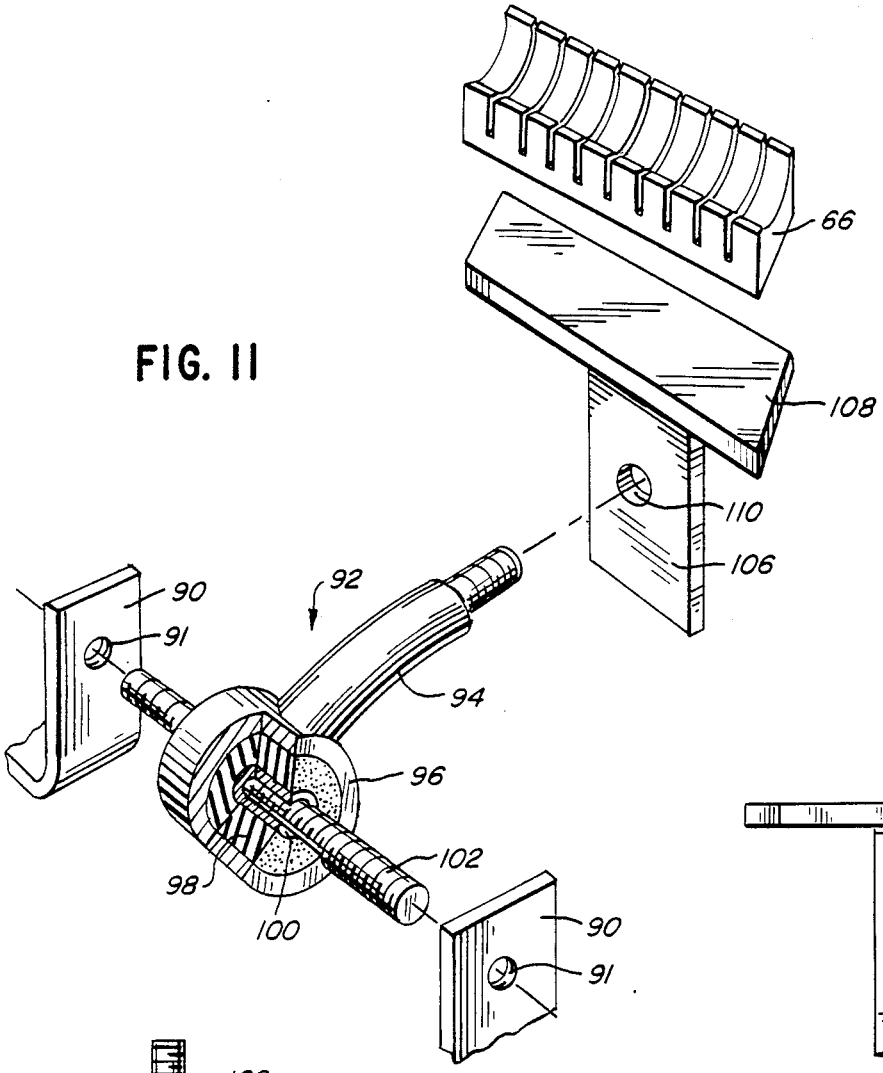
FIG. 11
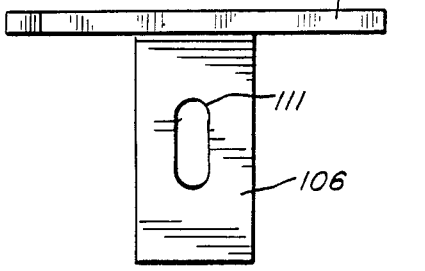
FIG. 14
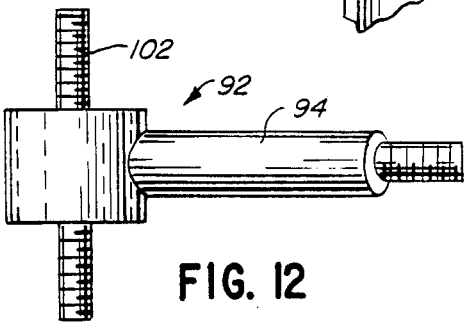
FIG. 12
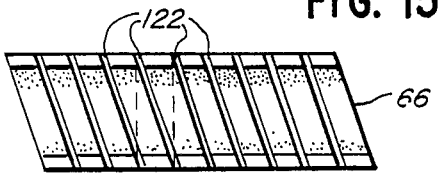
FIG. 15
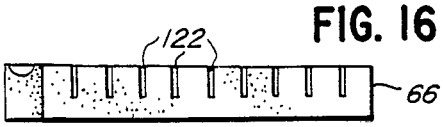
FIG. 16
FIG. 13
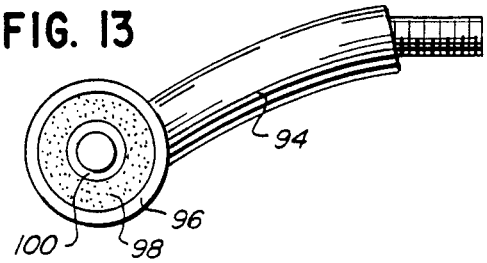
FIG. 17
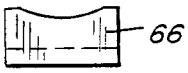

APPARATUS FOR CLEANING AND POLISHING ROLL ASSEMBLIES

BACKGROUND OF THE INVENTION

1. Field of the Invention

The present invention relates generally to an adjustable apparatus for use in cleaning and polishing rolls used in the rolling of sheet stock such as, for example, sheet steel, sheet plastic, paper, and the like.

2. Description of the Prior Art

During the manufacture and processing of sheet stock, such as, for example, sheet steel, sheet plastic, paper, and the like, it is oftentimes advantageous to wind the sheet stock on rolls or into coils for ease of handling, storage, and transportation. In preparing such large rolls of stock, it is also often necessary to translate the sheet stock through a series of motor and friction driven rolls prior to the final stage of forming the large rolls or coils. During the translation of the sheet stock across the motor and friction driven rolls, particles of metal, plastic, paper, and the like, may become dislodged from the stock and may build up on or become embedded in or otherwise damage the surface of the motor and friction rolls, particularly those rolls having a polished metallic surface. For example, in steel industry rolling mills, it has long been recognized that small metallic pieces, or chips, of the sheet steel stock being processed are dislodged from the strips of stock and build up on the surface of the motor and/or friction driven rolls used in the mills. These chips often build up on the surface of the rolls, with the result of not only damaging the surface of the rolls themselves but also damaging the stock being processed, such as by scratching or marking the stock. Obviously, metal, plastic, or other material so damaged cannot be used in producing a final consumer product because of surface imperfections caused by such scratching. Indeed, in certain steel industry rolling mill operations, surface scratching caused by small metallic chips may account for approximately 5–10% wastage of the processed sheet metal.

In the current rolling mill and other similar operations, various types of methods have been tried to clean the rolls. However, these methods have met with only limited success. For example, one such method involves attaching a piece of abrasive material, such as emery cloth, to the end of a 2"×4" board and, while an operator holds the opposite end of the board, putting the end of the board on which the emery cloth is fastened against the face of the roll as the roll is turned at high revolutions per minute. This method not only produces an unsatisfactory cleaning operation but also is extremely dangerous to the operator.

Further, other current cleaning methods involve shutting the line down, cutting the sheet stock and attempting to clean the rolls with hand-held power grinders.

In many instances, the surface of the polished rolls cannot be cleaned by these, and other, current practices and the rolling mill line must be shut down until the damaged rolls can be replaced. This contributes to additional operational expenses. For example, it is known that in certain steel industry rolling mill operations, downtime of the rolling mill apparatus may represent a cost approaching approximately $500.00 per minute of downtime.

Some mills have roll polishing machines that pneumatically force an abrasive stone block against the face of the roll. The stone block, with the associated pneumatic device, such as an air cylinder, is translated across the length of the surface of the roll at very slow rates of speed. When using such machines, by the time the stone block traverses the length of the roll, material builds up on the roll causing damage to the sheet stock. These machines, which are oftentimes driven by electric motors equipped with gear reduction devices, are expensive and require significant maintenance. In addition, due to the high contact pressure applied to the stone block and hence the roll, the surface finish of the roll is often damaged. This results in an added expense of refinishing the roll, at a cost approaching $5,000 to $7,500 per roll.

Other prior art devices used to clean and polish rolls have used a polishing block or stone, made from silicon carbide, felt, or the like, that is manually forced against the surface of the roll. One such prior art device was manufactured and sold by the assignee of the present application. That device had a series of polishing blocks attached to block holder arms. The holder arms were, in turn, attached, through a first rotational joint, to extensions of a first shaft. The first shaft was attached, at each end thereof, to shaft holders having arms extending therefrom. These arms were provided with second rotational joints through which passed a second shaft. The second shaft had a manually operated lever. In addition, the second rotational joints were connected to paired housings which were, in turn, attached to base plates. The base plates were adapted for attachment to support structures located on each side of the roll to be cleaned.

In use, the housings of this prior art device could be positioned along threaded shafts to control the height of the polishing blocks above the roll. When it was desired to cause the polishing blocks to contact the surface of the roll, the lever was manually depressed. The second rotational joints then allowed the arms, and hence the shaft holders, to move in an arcuate fashion toward the surface of the roll. The first rotational joint caused the polishing blocks to contact the surface of the roll substantially tangent to that surface. However, during operation, the polishing blocks displayed a marked tendency to scar the surface of the spinning roll due to the manual force required to maintain the blocks in contact with that surface. In addition, in that device, the blocks were held in position against the surface of the roll and did not traverse or oscillate across a portion of the roll's surface. This had the effect of causing a further scarring of the surface of the roll.

In my U.S. Pat. No. 4,528,716, issued on July 16, 1985, I disclosed a device for cleaning roll assemblies. That device utilizes a knife-edge blade arrangement to clean the surface of roll assemblies. However, that device did not provide a mechanism for polishing the rolls, nor did it provide a means for oscillating the blade arrangement across the surface of the roll.

On the other hand, the novel apparatus of the present invention overcomes the foregoing deficiencies noted in the prior art by providing an apparatus which cleans the surfaces of spinning rolls, generally across the entire length of the roll, removes therefrom the small chips which may damage the rolls and the sheet stock, and polishes the surface of the rolls to a relatively smooth surface. Accordingly, it is an object of the present invention to provide an apparatus for cleaning and polishing rolls which does not have the inherent deficiencies of the prior art.

It is another object of the present invention to provide a cleaning and polishing apparatus which includes at least one abrasive stone, and preferably more than one abrasive stone, positionable to contact the surface of the roll, thereby allowing the small chips to be removed from the roll prior to building up on the surface of the roll or otherwise damaging the surface of the sheet stock and permitting the roll to be polished.

It is yet a further object of the present invention to provide a cleaning and polishing apparatus which is adjustable through numerous axes so as to permit ready placement of the stone against the roll being cleaned.

These and other objects and advantages of the present invention will become apparent to those skilled in the art with reference to the foregoing, the attached drawings, and the description of the invention which hereinafter follows.

SUMMARY OF THE INVENTION

The present invention provides an apparatus for use in cleaning and polishing rotating (or spinning) rolls. The apparatus comprises abrasive stones attached to rotatable arms which, in one embodiment, may be flexible. The arms are attached to a support structure which can be translated to engage the stones on the surface of the roll. The support structure includes a means adapted for oscillating the stones across the surface of the roll to polish the surface thereof.

BRIEF DESCRIPTION OF THE DRAWINGS

FIG. 11 is an exploded perspective view of the arm connecting the abrasive stone holder used to clean and polish rolls;

FIG. 12 is a top view of the arm of FIG. 11;

FIG. 13 is a side view of the arm of FIG. 11;

FIG. 14 is a side view of the abrasive stone holder showing an alternative cut-out;

FIG. 15 is a top view of the abrasive stone;

FIG. 16 is a side view of FIG. 15;

FIG. 17 is an end view of the stone of FIG. 15;

DESCRIPTION OF THE PREFERRED EMBODIMENT

The present invention relates to an apparatus for use in rolling mills and, in particular, to an apparatus used for cleaning and polishing rolls and removing from the rolls pieces of metal chips or other materials which fall off of the sheet stock being processed in the rolling mill and for polishing the surface of the rolls.

Figure 1:
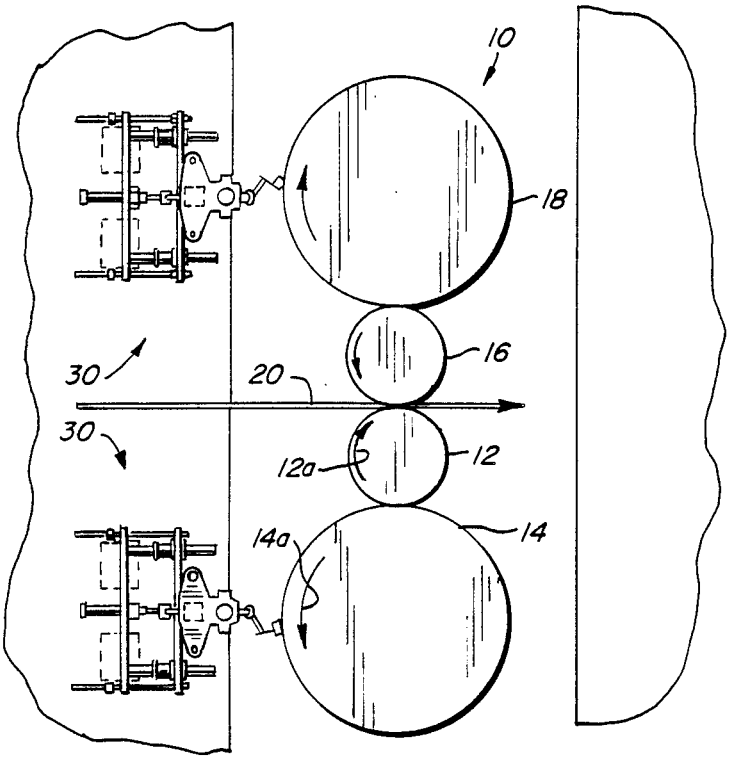
FIG. 1 is a partial end view of a portion of a rolling mill unit used in the steel industry and is provided to describe generally the types of rolling mill units with which the novel apparatus of the present invention can be used.

FIG. 1 depicts a section of a roll unit typically found in rolling mills of the steel industry. As there shown, the roll unit 10 comprises bottom work roll 12, bottom back-up roll 14, top work roll 16, and top back-up roll 18. Typically, one of the top back-up rolls is motor driven, with the remaining rolls being friction driven. The rolls 12 and 16 are positioned such that sheet stock 20 passes between and in contact with such rolls. Bottom work roll 12 engages bottom back-up roll 14, such that when work roll 12 rotates in the direction shown by the arrow 12*a* the back-up roll 14 is rotated in the direction shown by the arrow 14*a*. Top work roll 16 cooperates with top back-up roll 18 in a similar manner.

The cleaning and polishing apparatus of the present invention, shown generally in FIG. 1 as numeral 30 in conjunction with rolls 14 and 18, may be used to clean and polish those rolls, or either of them, and also rolls 12 and 16.

Figure 2:
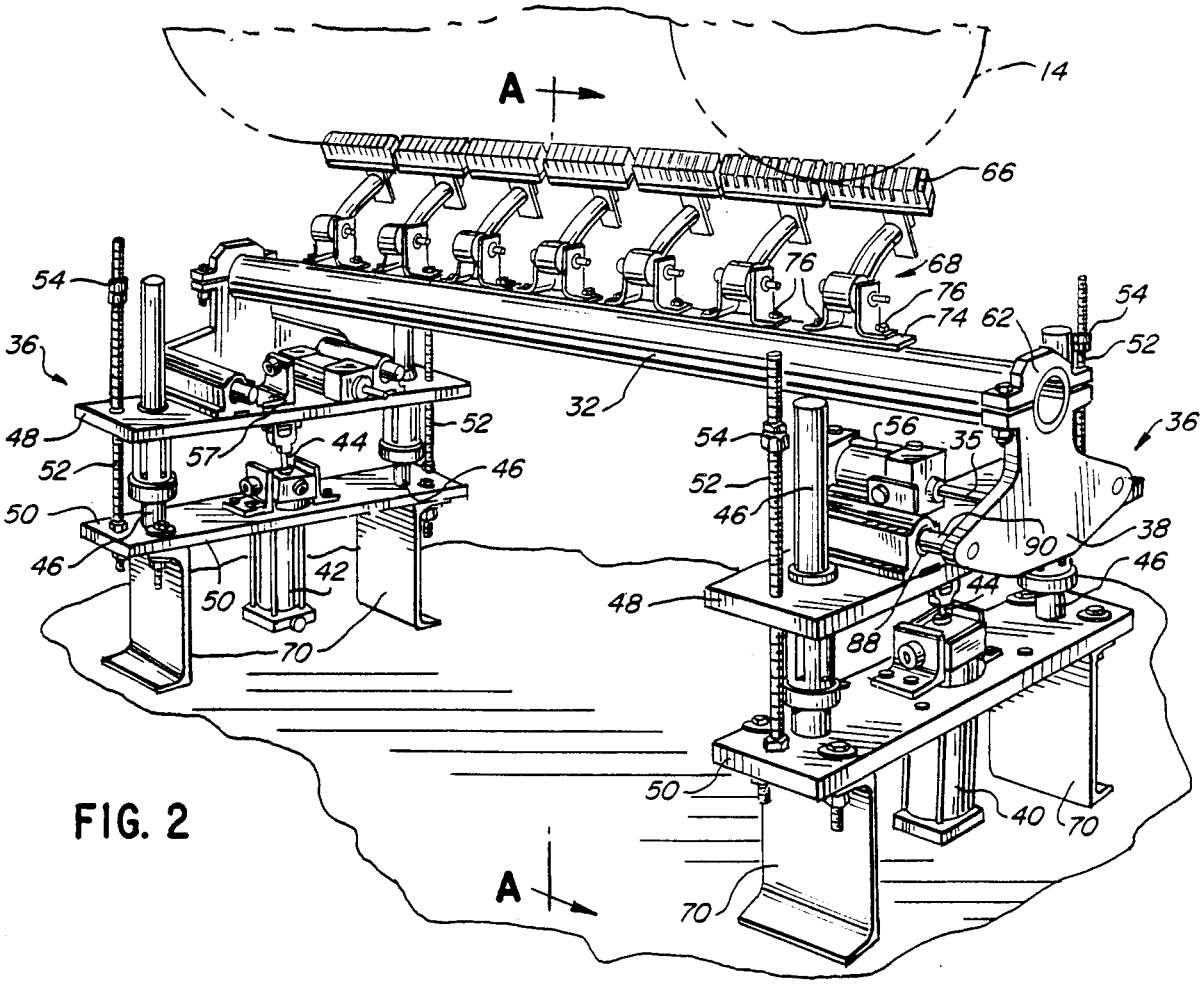
FIG. 2 is a perspective view of the apparatus of the present invention.
Figure 9:
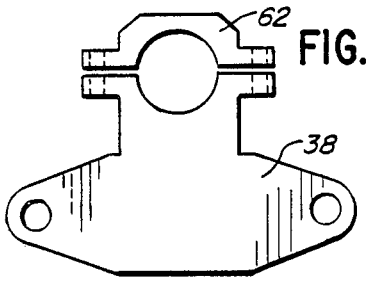
FIG. 9 is an end view of the main shaft support system.
Figure 10:
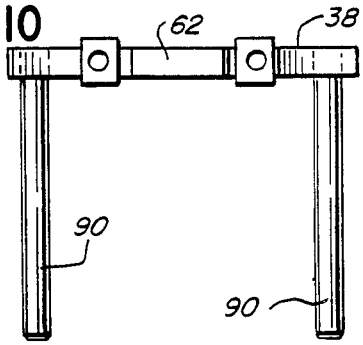
FIG. 10 is a top view of FIG. 9.

Referring now to FIG. 2, a perspective view of the apparatus of the present invention is shown. The apparatus, generally depicted by numeral 30, includes a main shaft 32 and end units 34 and 36. Each end unit includes a main shaft attachment plate 38 (see also FIGS. 9 and 10), a lift cylinder (lift cylinder 40 is associated with end unit 34 and lift cylinder 42 is associated with end unit 36), and a lift shaft 44. Each end unit also includes shafts 46 which cooperate with the lift cylinders 40 and 42 and top plates 48 and bottom plates 50. Plate 50 is engaged to plate 48 by threaded shafts 52; the shafts 52 are provided with lock nuts 54 that enable the movement of travel of the plates 48 to be controlled and limited.

End unit 34 is provided with a reciprocating air cylinder 56 which is attached, via shaft 35, to the main shaft attachment plate 38 of unit 34. End unit 36 is provided with a snubber 58 which is attached, via shaft 35, to the main shaft attachment plate 38 of unit 36. The main shaft 32 contains one or more abrasive stones 66, attached via attachment means 68, that can be positioned to contact the surface of a roll, such as roll 14 (shown in dashed lines), to clean and polish such surface while the roll 14 is rotating.

Finally, end units 34 and 36 may be provided with mounting brackets 70 for mounting the apparatus 30 in close proximity to the roll 14. In certain circumstances, the mounting brackets 70 are not used, and the plates 50 can therefore be attached to other mounting supports.

Figure 3:
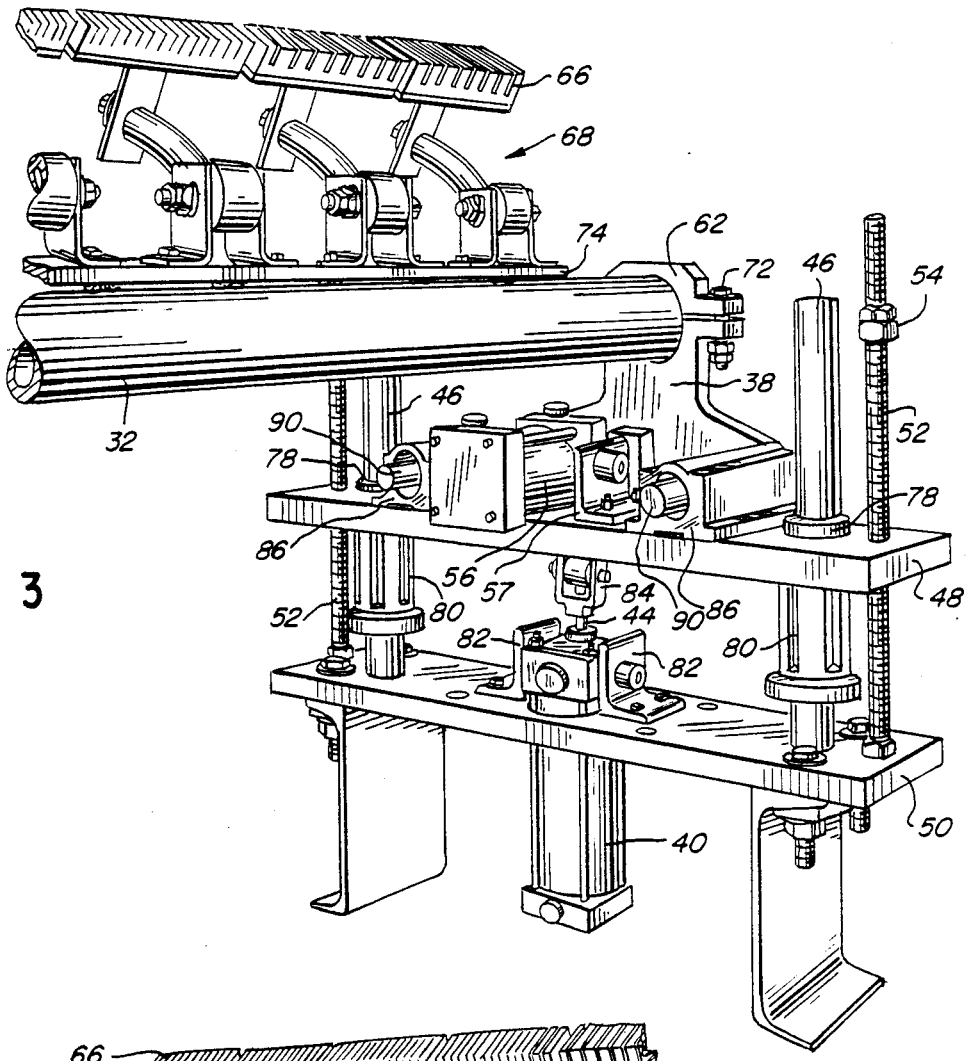
FIG. 3 is a perspective view of one end of the apparatus of the present invention, taken along the lines A—A of FIG. 2.

Referring now to FIG. 3, an end view of end unit 34 of the cleaning and polishing apparatus 30 of the present invention is generally shown. As there noted, the apparatus comprises the main shaft 32 held in place by the clamp 62 and the attachment plate 38 (see also FIGS. 9 and 10) with bolts 72 to secure the shaft 32 from rotation. When the bolts 72 of end unit 34 and corresponding bolts associated with end unit 36 are loosened, the main shaft 32 can be rotated about its longitudinal axis.

The main shaft 32 comprises a cylindrical member, which may be tubular in nature, such as a pipe. As noted, in one embodiment of the invention, the shaft 32 has prepositioned on it a strip 74 which may be welded or bolted to the shaft 32. The strip 74 is provided with paired holes (not shown) for receipt of bolts 76. The bolts 76 secure attachment means 68 to the strip 74 and hence the shaft 32. As noted in FIG. 2, seven attachment means 68 are provided. As will be appreciated hereinafter, the number of such means 68 may vary and is only dependent on the length of the roll to be cleaned and polished by the use of the apparatus of th present invention and the size of the abrasive stones (as described hereinafter).

Figure 7:
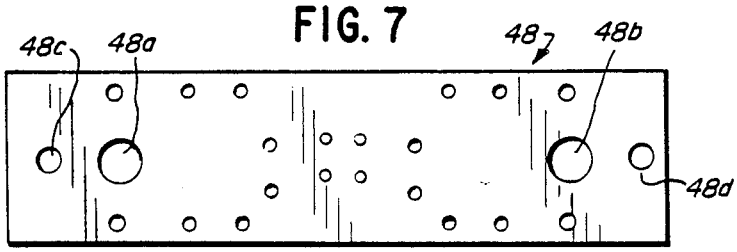
FIG. 7 is a top view of the top plate 48.

Referring again to FIG. 3, the end unit 34 of apparatus 30 is provided with the top plate 48 and the bottom plate 50. The top plate 48, which is further depicted in FIG. 7, is a plate that may be rectangular in shape, provided with holes 48*a* and 48*b*. The holes 48*a* and 48*b* are sized to receive a portion of ball bushings 78 (see FIG. 3). The top plate 48 also contains holes 48*c* and 48*d* for receipt of the threaded shafts 52. The ball bushings 78 depicted in FIG. 3 have positioned through the central bore thereof the shafts 46. One end of the shafts 46 is secured to bottom plate 50 through the use of set screws and the like (not shown). Portions of the shafts 46 may have a protective sleeve 80 therearound to protect the shaft from grit, debris, etc. Finally, the plate 48 is provided with holes 48*e* for the receipt of bolts and the like that cooperate with brackets 57 positioned on each side of the cylinder 5G to hold the cylinder in place.

Figure 8:
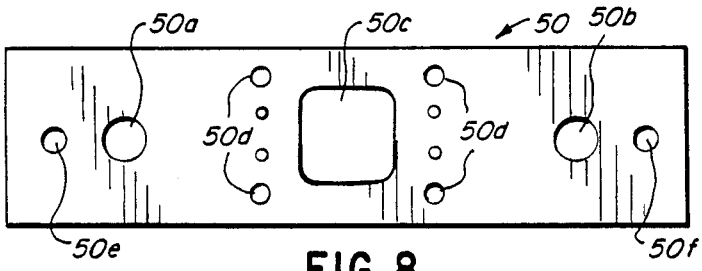
FIG. 8 is a top view of the bottom plate 50.

The bottom plate 50 is further depicted in FIG. 8. As there shown, the plate 50 contains holes 50*a* and 50*b* for receipt of the shafts 46. The lift plate 50 also contains a cut-out 50*c* for receipt of a portion of the lift cylinder 40. Mated to the upper surface of the plate 50, as by screws or the like engaged in the holes 50*d*, are angle brackets 82 (see FIG. 3). The angle brackets 82 are, in turn, attached to a portion of the lift cylinder 40 to hold that cylinder in place. Holes 50*e* and 50*f* receive a portion of the shafts 46.

With reference to FIG. 3, the lift cylinder 40 is operated, as by compressed air (compressed air lines not shown), to cause the shaft 44 to move in an upwardly and downwardly direction (with reference to FIG. 3; it should be understood that the movement is more accurately described as being directed toward and away from the surface of the roll 14). The shaft 44 is attached through attachment means 84, which may be for example a pin and clevis arrangement, to the bottom surface of plate 48.

Attached to the opposite surface of the plate 48 are slide bearing housings 86. The slide bearing housings 86 have disposed therein slide bearings 88 and slide bearing shafts 90.

As shown in FIG. 2, the slide bearing shafts 90 are attached, as by welding or tapping, to the main shaft attachment plate 38 and spaced apart from the shaft support 60. As noted, the main shaft attachment plate 38 cooperates with the reciprocating air cylinder 56 via shaft 35.

Figure 4:
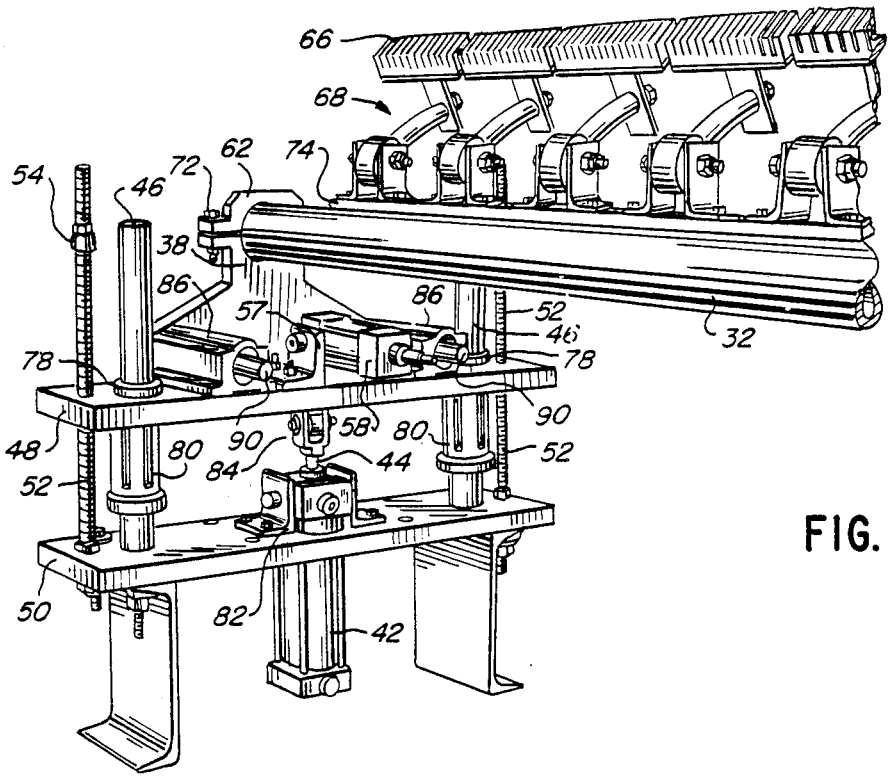
FIG. 4 is a perspective view of the apparatus of the present invention showing the end opposite that shown in FIG. 3.

As depicted in FIG. 4, the end unit 36 opposite the end unit 34 is provided with a snubber 58, which may be an hydraulic snubber, for purposes hereinafter described. The snubber 58 is attached to the attachment plate 38 of end unit 36 via shaft 35.

As will be appreciated with reference to FIGS. 3 and 4, the apparatus of the present invention may be conveniently described with reference to end units 34 and 36. End unit 34 includes the reciprocating air cylinder 56 and lift cylinder 40. End unit 36 contains the snubber 58 and lift cylinder 42. As will be further appreciated with reference to FIGS. 3 and 4, components found in end unit 36 that are comparable to those found in end unit 34 have eeen given the same numerical designation.

As previously noted, with respect to FIG. 2, the shaft 32 is provided with abrasive stone attachment means 68. The means 68 is shown in FIG. 11. As there shown, brackets 90, having threaded holes 91, are provided to be secured at one end to the strip 74 through bolts and the like, or by welding. Positioned between the brackets 90 is the abrasive stone support system 92. The support system 92, includes arm 94 which is secured to tubular shaft 96. The tubular shaft 96 contains a resilient elastomeric region 98 that surrounds tube 100 having internal threads (not shown). A threaded shaft 102 engages the internal threads of the tube 100, with the ends of the threaded shaft 102 extending beyond the brackets 90. Jam nuts (not shown) may be threaded on the shaft 102 to secure the shaft 96 to the brackets 90 and hence the shaft 32. In addition, the end of the arm 94 (which may have an arcuate shape as shown in FIG. 13) opposite the tubular shaft 96 includes a threaded extension 104 adapted to be secured, as with a nut (not shown), to extension 106 of abrasive stone plate 108. The extension 106 may be provided with a hole 110 or with an elongated cut-out 111 (see FIG. 14) to permit positioning of the stone plate 108 in relation to the surface of the roll 14.

The resilient elastomeric region 98 surrounding the tube 100 provides distinct advantages to the present invention, as will be described hereinafter.

The abrasive stones 66 used in the present invention are depicted in FIG. 15. As there shown, the stones 66 are advantageously shaped in parallelogram fashion. Each stone 66 has a plurality of cut-outs 122 aligned in a substantially parallel manner. The stones 66 are attached to the plate 108 by using a high strength glue or epoxy resin.

The shape of the stone 66, as depicted in FIG. 15, provides significant advantages in the present invention. For example, when the stones 66 are so formed, the forward edge of a cut-out 122 overlaps a portion of the next cut-out 122 of the stone 66 (as depicted by the dashed lines in FIG. 15). With such arrangement, material removed from the roll 14 during the cleaning and polishing is channeled away from the surface of the roll 14. Because this overlap can also occur in relation to adjacent stones when such stones are shaped in parallelogram fashion and positioned accordingly, there is a decreased likelihood that material will build up on the stones 66 to hinder the cleaning and polishing operation. Further, as shown in FIGS. 16 and 17, each stone 66 is formed with a slight curvature. In practice, it has been determined that this curvature should match closely the curvature of the roll 14 that is to be cleaned so that a substantial portion of the surface of the stone 66 will make contact with the surface of the roll 14.

Figure 5:
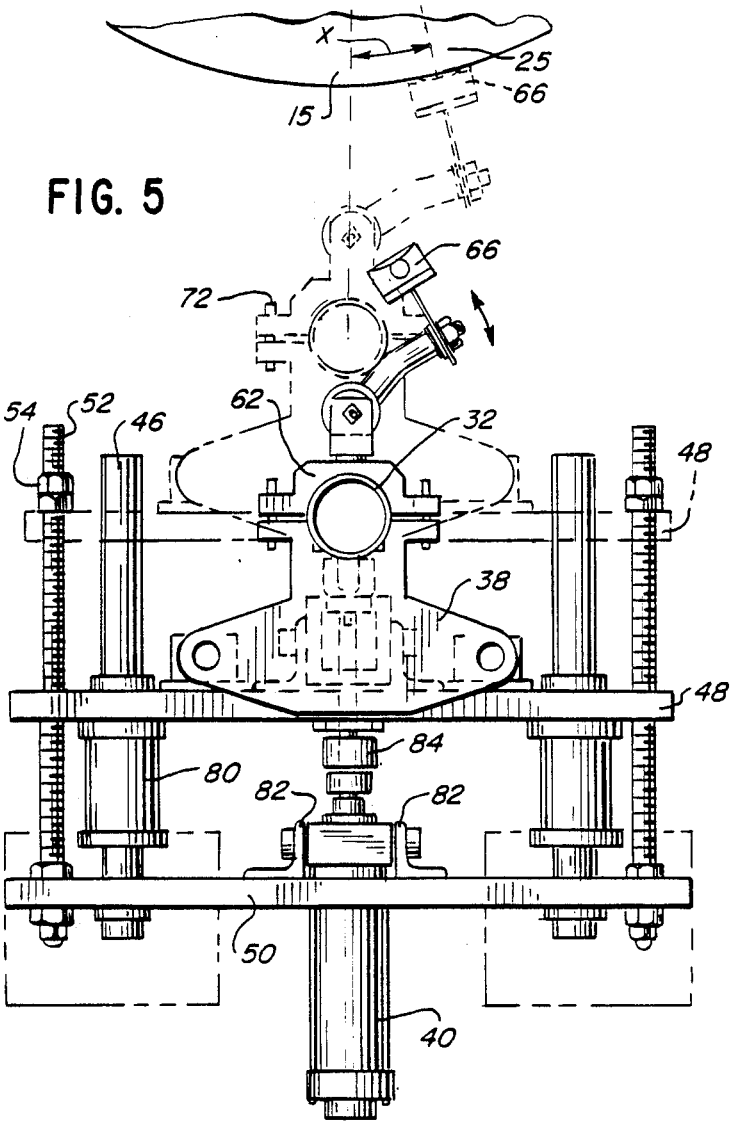
FIG. 5 is an end view of the present invention shown in FIG. 3 and further showing the position of the present invention when in use.
Figure 6:
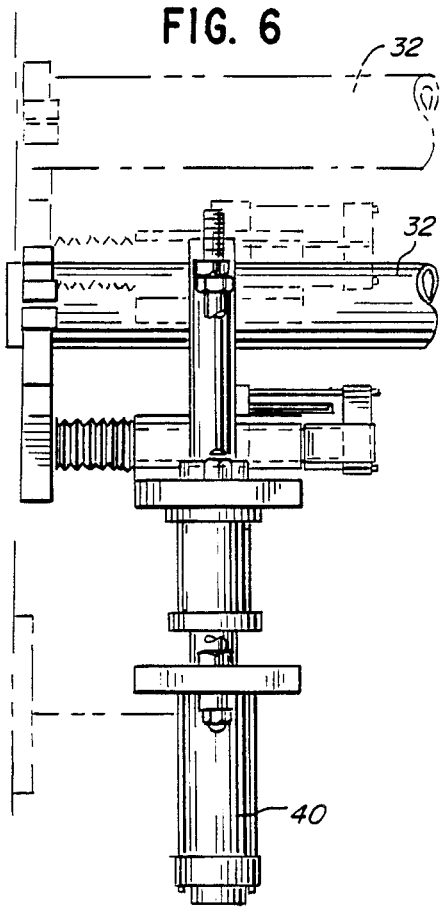
FIG. 6 is a partial side view of FIG. 5 taken along the lines B—B.

In one embodiment of the present invention, it is to be noted with reference to FIGS. 5 and 6 (the phantom lines indicating that the main shaft 32 has been moved toward the surface of the roll 14), that when in use the abrasive stone support system 92 is positioned in an angular fashion with respect to the longitudinal axis of the main shaft 32 and the roll 14. That is, if a radial line is extended from the central axis of the roll 14 and intersects the central axis of the main shaft 32 (such line is shown in FIG. 5 as a dashed line with the numeral 15) and another line is extended from the central axis of the roll 14 and intersects the abrasive stone 66 (show in FIG. 5 as dashed line with the numeral 25), an angle X is formed. It has been advantageously found that when the abrasive stone support system 92 is so positioned and the angle X is from about 10° to about 25°, the abrasive stone 66 makes substantial contact with the surface of the roll 14.

Figure 18:
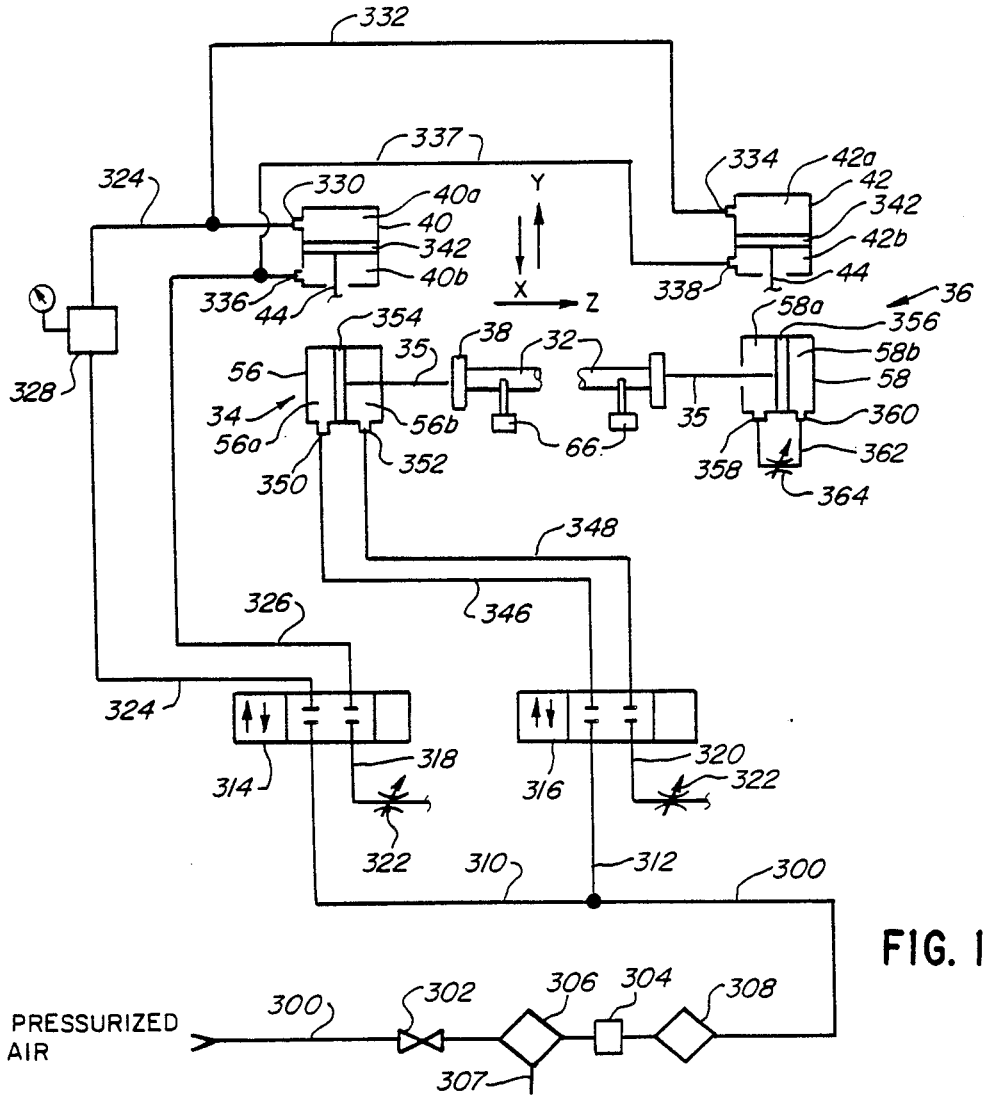
FIG. 18 is a representative schematic of the pneumatic control of the apparatus of the present invention.

FIG. 18 represents a block diagram of the pneumatic system utilized with the apparatus of the present invention. As there depicted (and as further described with reference to FIGS. 2, 3, 4, and 5 above), the lift cylinder 42 of end unit 36 is mated via shaft 44 to top plate 48 (not shown in FIG. 18). Top plate 48 is, in turn, mated to snubber 58 in cooperation with main shaft attachment plate 38 (not shown in FIG. 18). Similarly, in end unit 34, the lift cylinder 40 is mated via shaft 44 to top plate 48; top plate 48 is, in turn, mated to reciprocating air cylinder 56 in cooperation with attachment plate 38.

In using the apparatus of the present invention, pressurized air, which may be pressurized to for example from about 50 p.s.i.g. to about 100 p.s.i.g., enters line 300, which may be provided with shut-off 302 and pressure regulator 304. The pressurized air flows through a filter/separator 306 to filter the air and separate therefrom contaminants such as water; drain 307 is provided in filter/separator 306 as is standard in the art. The filtered air is then flowed across pressure regulator 304 and may then be flowed, if necessary, through lubricator 308 to add minor amounts of a lubricant, as is also standard in the art. The air is then flowed through line 300, with the line 300 being split into lines 310 and 312. Lines 310 and 312 feed into similar four-way, three-position valves 314 and 316. The valves 314 and 316, which may be for example valves sold by Miller Fluid Power, Model No. 340-2 DSNC, are constructed such that air can flow in either direction shown by the arrows; when all ports in the valves 314 or 316 are blocked the valves are in "neutral" and no air flows across them. The valves 314 and 316 are provided with exhaust lines 318 and 320, respectively; each such exhaust line may contain a restriction valve 322 to control the amount of exhaust.

Referring now to valve 314, FIG. 18 depicts lines 324 and 326. Line 324 communicates through pressure regulator 328 with a first portion 40*a* of the lift cylinder 40 associated with end unit 34, through two-way valve 330. In addition, line 332, which is connected to line 324 downstream from regulator 328, communicates with a first portion 42*a* of the lift cylinder 42 associated with end unit 36 through two-way valve 334.

Referring now to line 326, FIG. 18 depicts that that line communicates with a second portion 40*b* of the lift cylinder 40 associated with end unit 34 through a two-way valve 336. Line 337 communicates with line 336 and further communicates with a second portion 42*b* of the lift cylinder 42 associated with end unit 36 through a two-way valve 338. The lift cylinders 40 and 42 depicted in FIG. 18 each contain a piston 342. The piston 342 divides cylinder 40 into the portions 40*a* and 40*b* and cylinder 42 into the portions 42*a* and 42*b*.

Referring again to valve 314, it will be appreciated by one skilled in the art that when pressurized air flows into valve 314 and the valve is activated such that air can flow forwardly toward regulator 328 through line 324, the air will enter the first portions 40*a* and 42*a* of the cylinders 40 and 42, respectively. Given sufficient air pressure, the pistons 342 in the respective cylinders will be forced in the direction of the arrow denoted as "x". This, in turn, will cause the shafts 44, which are operably connected to the pistons 342 through gas tight seals (not shown), to move in conjunction, resulting in movement of the top plates 48 of end units 34 and 36 toward the surface of the roll 14, thereby causing the shaft 32 to move in the same manner and allowing stones 66 to contact the surface of the roll 14. Furthermore, air trapped in the second portions 40*b* and 42*b* of the cylinders 40 and 42 will flow through the associated two-way valves 336 and 338 through lines 337 and 326 back into valve 314 and be exhausted via line 318.

When it is desired to move the stones 66 from the surface of the roll 14, air is flowed from line 310 through valve 314 and into lines 326 and 337. When this occurs, the second portions 40*b* and 42*b* of the cylinders 40 and 42 pressurize and force the pistons 342 in the direction of the arrow denoted as "y". Air trapped in the first portions 40*a* and 42*b* will flow through the associated two-way valves 330 and 334 back into valve 314 and will be exhausted via line 318.

Referring now to line 312, FIG. 18 depicts valve 316 communicating with line 312. The valve 316 has associated with it lines 346 and 348. Line 346 communicates through two-way valve 350 with a first portion 56*a* of the reciprocating air cylinder 56 and line 348 communicates through two-way valve 352 with a second portion 56*b* of the air cylinder 56. The air cylinder 56 of end unit 34 has disposed therein a piston 354 which divides the cylinder 56 into portions 56*a* and 56*b*. The piston 354 is operably connected through a gas tight seal (not shown) to the shaft 32 via the main shaft attachment plate 38 and the shaft 35. As noted above, the end unit 36 has associated therewith the snubber 58. Snubber 58 is connected to the shaft 32 via the main shaft attachment plate 38 and the shaft 35. The snubber 58 is divided into a first portion 58*a* and a second portion 58*b* by piston 356; piston 356 is operably connected through a gas tight seal (not shown) to the shaft 35 of end unit 36.

The first portion 58*a* of snubber 58 contains a two-way valve 358 and is in fluid communication with the second portion 58*b* through two-way valve 360 and line 362. Line 362 may contain restriction valve 364.

When pressurized air flows through line 312 across valve 316 and through line 346, the piston 354 will be moved parallel to the longitudinal axis of the shaft 32 and generally in the direction of the arrow noted as "z" in FIG. 18. Air trapped in the second portion 56*b* of the air cylinder 56 will be forced through the two-way valve 352 and line 348 to the valve 316 where it is exhausted through line 320 and restriction valve 322.

When the shaft 32 travels in the direction of the arrow denoted as "z", the snubber 58 acts to dampen the travel. This occurs by movement of the piston 356 which forces fluid, such as air, from the second portion 58*b* into the first portion 58*a*. Adjustment of the restriction valve 364 allows control of the dampening action. As will be appreciated, the snubber 58 advantageously allows the movement of the shaft 32 to occur in a relatively smooth fashion.

When the travel of the piston 356 reaches a forward pre-set limit, a switch is activated which causes valve 316 to channel the pressurized air through the line 348 into the second portion 56*b* of the air cylinder 56. Such pressurized air reverses the travel of the piston 354 and, hence, the shaft 32 and the piston 356. As a result, air trapped in the first portion 56*a* of the cylinder 56 is forced through line 346 and the valve 316 and is exhausted through line 320. When the piston 356 reaches a rearward pre-set limit, another switch is activated which causes valve 316 to again channel pressurized air through the line 346 to cause the main shaft to move in the direction of the arrow denoted by "z" in FIG. 18.

Accordingly, the pneumatic control system depicted in FIG. 18 permits the end units 34 and 36 to be lowered and raised with reference to the surface of the roll 14. When the stones 66 are in contact with the surface of the roll 14, the pneumatic control system also permits the shaft 32 and the associated stones 66 to oscillate (or reciprocate) across the surface of the roll 14.

Figure 19:
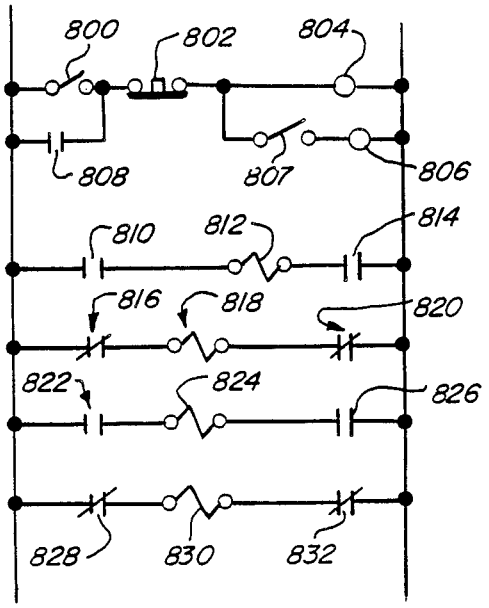
FIG. 19 is a representative schematic of a portion of the electrical circuitry of the present invention.

The foregoing action occurs by virtue of the electrical circuitry of the present invention, a schematic of which is shown in FIG. 19. As there noted, when "start" switch 800 is depressed, relay 804 is energized through the normally closed contacts of "stop" button 802. Relay 804 activates the lift cylinders 40 and 42 when switch 800 is depressed. Further, normally open contact 808 closes and solenoid 812 is energized when normally open contacts 810 and 814 close. Solenoid 812 causes lift cylinders 40 and 42 to move toward the surface of the roll 14. When solenoid 812 is energized, normally closed contacts 816 and 820 open and solenoid 818 is deenergized. Solenoid 818, when energized, causes lift cylinders 40 and 42 to move away from the surface of the roll 14. In addition, normally closed contacts 828 and 832 energize solenoid 830 which causes the stones 66 to start lateral travel across the surface of the roll 14. When such travel trips a microswitch (not shown) associated with the snubber 58, normally open contact 807 is closed, contacts 828 and 832 open and solenoid 830 is deenergized. Concurrently, normally open contacts 822 and 826 close, thereby activating solenoid 824 which reverses the direction of travel of the stones 66 across the surface of the roll 14.

The reciprocating motion of the stones 66 continues until the "stop" button 802 is depressed, thereby breaking the circuit. Upon such occurrence, relay 804, and 806 are deenergized; normally closed contacts 816, 820, 828, and 832 close, the lift cylinders 40 and 42 move the stones 66 from the surface of the roll 14 and the reciprocating motion ceases.

As will be apparent from the foregoing, the apparatus of the present invention is advantageously designed to permit ready adjustment. For example, the travel of the shaft 32 toward the surface of the roll 14 can be controlled by positioning the lock nuts 54 on the threaded shafts 52. This enables the apparatus 30 to be used to clean and polish rolls of varying diameters. In addition, when the bolts 72 associated with attachment plate 38 and the clamp 62 are loosened, the shaft 32 can be rotated about its longitudinal axis to enable speedy positioning of the abrasive stone attachment means 68 in relation to the roll to be cleaned and polished. Furthermore, the pneumatic control system allows the speed of oscillation (or reciprocation) of the abrasive stones across the surface of the roll to be controlled and permits adjustment to the speed and the travel of the stones across the roll.

Furthermore, each abrasive stone support system 92 can be rotated about the axis of the shaft 102 to position the system 92 in relation to the surface of the roll to be cleaned and polished. Once the desired position is obtained, jam nuts (not shown) hold the system 92 in place.

Finally, the resilient elastomeric region 98 acts in a spring-like fashion when the abrasive stones 66 are in contact with the surface of the roll 14. This advantageously allows each abrasive stone support system 92 to move in response to the surface of the roll, including any surface imperfections associated therewith, and assists in creating substantial contact between the abrasive stones 66 and the surface of the roll 14.

These and other advantages of the present invention will be readily apparent to one skilled in the art.

While the foregoing invention has been shown and described with reference to the attached drawings and a preferred embodiment, it will be appreciated that modifications and changes to the foregoing can be made while still falling within the intent and spirit of the invention.

What is claimed is:

1. An apparatus for cleaning and polishing the surface of a cylindrical roll, comprising a shaft removably attached at one end thereof to a first end unit and removably attached at the other end thereof to a second end unit;

said first and second end units each being provided with lift means for moving said shaft from a first position to a second position;

said first end unit being further provided with a reciprocating means for translating said shaft alternately along its longitudinal axis;

said second end unit being further provided with a damping means cooperating with said reciprocating means for damping the longitudinal translation of said shaft;

at least one abrasive stone support means attached to said shaft, with each such support means including an arm having a resilient joint associated therewith and an abrasive stone attached thereto; and a control means cooperating with said lift means for moving said shaft from the first position to the second position and further cooperating with said reciprocating means for translating said shaft alternately along its longitudinal axis.

2. The apparatus of claim 1, further including an electrical control means cooperating with said control means for actuating said lift means and said reciprocating means.

3. The apparatus of claims 1 or 2, wherein each of said first and second end units is provided with adjustment means for adjusting the movement of said shaft.

4. The apparatus of claims 1 or 2, wherein said lift means is responsive to pressurized fluid.

5. The apparatus of claims 1 or 2, wherein said reciprocating means is responsive to pressurized fluid.

6. The apparatus of claims 1 or 2, wherein said control means is a pneumatic control means.

7. The apparatus of claims 1 or 2, wherein said abrasive stone support means includes a plurality of abrasive stones.

8. The apparatus of claims 1 or 2, wherein said abrasive stone is provided with angled cut-outs, with each cut-out being defined by a portion of the abrasive stone such that each cut-out overlaps a portion of the next adjacent cut-out.

9. An apparatus for cleaning and polishing the surface of a cylindrical roll, comprising a shaft removably attached at one end thereof to a first end unit and removably attached at the other end thereof to a second end unit;

said first and second end units each being provided with pneumatically responsive lift cylinders that cooperate with said first and second end units to move said units from a first position to a second position;

said first end unit being further provided with a pneumatically responsive reciprocating cylinder that cooperates with said first and second end units and said shaft to translate said shaft alternately along its longitudinal axis;

said second end unit being further provided with a damper that dampens the translation of said shaft;

a plurality of abrasive stone supports attached to said shaft, with each such support including an arm having a resilient joint associated therewith and an abrasive stone attached thereto;

a pneumatic control that actuates said first lift cylinders and said reciprocating cylinder; and an electric control that actuates said pneumatic control.

10. The apparatus of claims 1 or 9, wherein said arm is curvilinear in shape.

11. The apparatus of claims 1 or 9, wherein said abrasive stones are contoured to match the radius of curvature of the roll being cleaned and polished.

12. The apparatus of claim 1 or 9, wherein said abrssive stones are contoured to match the radius of curvature of the roll being cleaned and polished and wherein each such abrasive stone is provided with a plurality of angled cut-outs, with each such cut-out being defined by a portion of the abrasive stone such that each cut-out overlaps a portion of the next adjacent cut-out.

13. The apparatus of claim 9, wherein each of said first and second end units is adjustable to position the shaft in relation to the surface of the roll to be cleaned and polished.

* * * * *

UNITED STATES PATENT AND TRADEMARK OFFICE

CERTIFICATE OF CORRECTION

PATENT NO. : 4,841,675

DATED : June 27, 1989

INVENTOR(S) : George C. Perneczky

It is certified that error appears in the above-identified patent and that said Letters Patent is hereby corrected as shown below:

Column 5, line 8, "th" should be --the--.

Column 6, line 4, "eeen" should be --been--.

Column 12, line 6, "abrs-" should be --abra- --.

Signed and Sealed this

Tenth Day of April, 1990

*Attest:*

HARRY F. MANBECK, JR.

*Attesting Officer*

*Commissioner of Patents and Trademarks*